US010036581B1

(12) United States Patent
Koplow

(10) Patent No.: US 10,036,581 B1
(45) Date of Patent: Jul. 31, 2018

(54) HEAT TRANSFER ASSEMBLIES, SYSTEMS, AND METHODS FOR CONDITIONING A MEDIUM

(71) Applicant: National Technology & Engineering Solutions of Sandia, LLC, Albuquerque, NM (US)

(72) Inventor: Jeffrey P. Koplow, San Ramon, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 916 days.

(21) Appl. No.: 14/295,137

(22) Filed: Jun. 3, 2014

Related U.S. Application Data

(60) Provisional application No. 61/830,809, filed on Jun. 4, 2013.

(51) Int. Cl.
*F25B 21/04* (2006.01)

(52) U.S. Cl.
CPC ..... *F25B 21/04* (2013.01); *F25B 2321/02* (2013.01)

(58) Field of Classification Search
CPC ..... F25B 2321/02; F25B 2321/021; F25B 2321/0211; F25B 2321/0212; F25B 2321/023; F25B 21/04
See application file for complete search history.

(56) References Cited

U.S. PATENT DOCUMENTS 3,019,609 A * 2/1962 Pietsch ..... F24F 5/0042 62/3.3
3,085,405 A * 4/1963 Frantti ..... A62B 17/005 607/104
3,392,535 A * 7/1968 De Coye De Castelet ..... B60H 1/00478 136/205
4,491,173 A * 1/1985 Demand ..... H01L 21/67248 165/11.1
5,090,259 A * 2/1992 Shishido ..... G01N 21/954 324/220
5,125,069 A * 6/1992 O'Boyle ..... A61M 5/44 165/146
8,183,456 B1 * 5/2012 Schroeder ..... H01L 35/00 136/200
8,228,675 B2 7/2012 Koplow
RE44,272 E * 6/2013 Bell ..... F25B 21/04 165/86
8,468,837 B2 * 6/2013 Pinet ..... F25B 21/02 363/39
2002/0121094 A1 * 9/2002 VanHoudt ..... F25B 21/04 62/3.3

(Continued)

OTHER PUBLICATIONS

Frequently Asked Questions About Our Cooling and Heating Technology, http://www.tellurex.com/technology/peltier-faq.php, accessible at least as early as Dec. 16, 2013.

*Primary Examiner* — Filip Zec
(74) *Attorney, Agent, or Firm* — Madelynne J. Farber

(57) ABSTRACT

Embodiments of the invention are directed to heat exchanger assemblies, systems, and methods for conditioning medium in an environment (e.g., in a controlled environment) to a suitable temperature. In particular, embodiments may include heat transfer assemblies and medium conditioning systems that may condition the medium in the environment by raising or lowering temperature thereof to a suitable conditioned temperature.

20 Claims, 5 Drawing Sheets

(56) References Cited

U.S. PATENT DOCUMENTS

| | | | | |
|---|---|---|---|---|
| 2005/0126022 | A1* | 6/2005 | Hansberry | E21B 47/022 33/313 |
| 2006/0021735 | A1* | 2/2006 | Lopatinsky | H01L 23/467 165/80.3 |

* cited by examiner

HEAT TRANSFER ASSEMBLIES, SYSTEMS, AND METHODS FOR CONDITIONING A MEDIUM

CROSS-REFERENCE TO RELATED APPLICATIONS

This application claims priority to U.S. Provisional Application No. 61/830,809 filed on 4 Jun. 2013, the disclosure of which is incorporated herein, in its entirety, by this reference.

STATEMENT REGARDING GOVERNMENT RESEARCH AND DEVELOPMENT

This invention was made with Government support under government contract no. DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

BACKGROUND

Various commercial applications may require conditioning a medium, such as fluid in an environment. For example, occupants of a building may have a preferred air temperature range for their environment. Thus, controlling air temperature in the building or a portion of the building may provide a comfortable environment for the occupants. Moreover, controlling the medium temperature in an environment may be necessary or preferable for sustaining life and/or preventing damage to property. For instance, a preferred temperature range may be required for vitality of fish and other living organisms. Similarly, maintaining a particular temperature range in an environment may sustain and promote growth of plants. In addition, maintaining a temperature range in an environment may avoid damaging equipment (e.g., avoid freezing of fluid in lines, overheating, etc.) and other property.

In some instances, the difference a suitable temperature of the medium in a controlled environment and the medium temperature outside thereof may be relatively small (e.g., 10° C.). For instance, the preferred air temperature in the building may be about 25° C., while the air temperature outside may be about 35° C. To cool the air in the building to a suitable temperature, a medium conditioning system (e.g., an air conditioner) may be used.

Therefore, manufacturers and users of medium conditioning systems continue to seek systems with improved useful life, operating efficiency, low noise, and/or other logistical advantages.

SUMMARY

Embodiments of the invention are directed to devices, systems, and methods for conditioning medium in an environment (e.g., in a controlled environment) to a suitable temperature. In particular, embodiments may include heat transfer assemblies and medium conditioning systems that may condition a medium in an environment by raising or lowering a temperature thereof to a suitable conditioned temperature. For example, as the temperature of the medium in the environment changes, such as to fall outside of a suitable range, the medium may be circulated through the heat transfer assembly and/or through the medium conditioning system, which may change the temperature of the medium in a manner that modulate the overall fluid temperature in the environment to a suitable temperature.

An embodiment includes a system for conditioning a medium in an environment. Such system may include a housing sized and configured to at least partially separate a first fluid at a first location from a second fluid at a second location. The system may also include a heat transfer assembly rotatably connected to the housing. The heat transfer assembly may include a thermoelectric heat pump having a first thermal side and a second thermal side. The thermoelectric heat pump may be configured to produce a temperature differential between the first thermal side and the second thermal side thereof. The heat transfer assembly may also include a heat exchanger in thermal communication with the first thermal side of the thermoelectric heat pump. The heat exchanger may be attached to the thermoelectric heat pump. Moreover, the heat exchanger may include one or more heat transfer features extending away from the first thermal side of the thermoelectric heat pump.

In an embodiment, the heat transfer assembly includes a second heat exchanger in thermal communication with the second thermal side of the thermoelectric heat pump. The second heat exchanger is also attached to the thermoelectric heat pump.

Embodiments of the invention also are directed to a method of conditioning a medium in an environment. The method may include providing electrical power to a thermoelectric heat pump, thereby producing heat flow from a first thermal side to a second thermal side of the thermoelectric heat pump. The method may further include rotating a heat transfer structure, such as an impeller-type heat exchanger, in the medium, wherein such a heat transfer structure is in thermal communication with the thermoelectric heat pump during rotation. In addition, the method may include drawing the medium into the rotating heat transfer structure and expelling the medium out of the rotating heat transfer structure.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
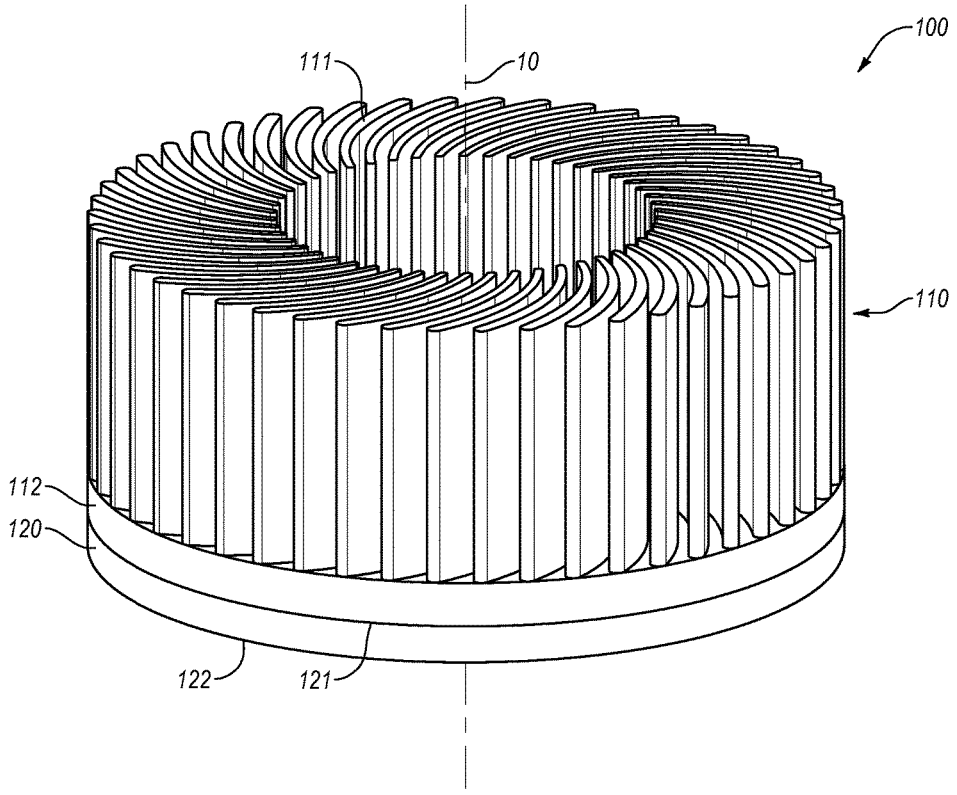
FIG. 1A is an isometric view of a heat transfer assembly according to an embodiment of the invention.

Embodiments of the invention are directed to heat transfer assemblies, systems, and methods for conditioning medium in an environment (e.g., in a controlled environment) to a suitable temperature. In particular, embodiments may include heat transfer assemblies and systems that may condition the medium in the environment by raising or lowering temperature thereof to a suitable conditioned temperature for cooling a room, cooling the inside of a container for holding food or medicine, or numerous other applications. For example, as the temperature of the medium in the environment changes, such as to fall outside of a suitable range, the medium may be circulated through the heat transfer assembly and/or through the medium conditioning system, which may change the temperature of the medium in a manner that modulates the overall fluid temperature in the environment to a suitable temperature.

As used herein, the term "medium" refers to fluids, such as gasses, liquids, plasmas, and semi-liquid substances, as well as other substances that may exhibit flow-like behavior, such as granular substances and the like. In some instances, the temperature of the medium may be lowered, while in other instances, the temperature may be raised. Accordingly, the medium conditioner may adjust the temperature of the medium (e.g., in the controlled environment) to a suitable temperature by conditioning the medium. In some embodiments, the temperature of the conditioned medium may be lower than the target suitable temperature, which may allow the overall temperature in the environment to adjust to a suitable temperature after mixing the conditioned medium with unconditioned medium (i.e., medium in the environment that has not circulated through the medium conditioner). Similarly, the conditioned temperature of the medium exiting the medium conditioner may be higher than the suitable temperature for the environment, such that the conditioned medium may mix with the unconditioned medium in the environment to adjust the overall temperature to the suitable temperature for the environment.

In some embodiments, the same medium conditioning system may heat and cool the medium, depending on the particular temperature adjustment needed to modulate the overall temperature of the medium to a suitable temperature. In particular, the medium conditioner may be adjustable from cooling to heating the medium without modifying and/or changing equipment. Moreover, the medium conditioner may change from heating to cooling (and vice versa) incrementally or gradually, which may facilitate maintaining the medium temperature in the controlled environment within a suitable range, irrespective of temperature change outside of the controlled environment.

Generally, the heat transfer assembly may exchange heat with the medium circulated therethrough. In an embodiment, the medium conditioner that includes the heat transfer assembly may remove heat from the medium circulated therethrough. Additionally or alternatively, the medium conditioner may transfer heat to the medium circulated therethrough. For example, the heat transfer assembly may include a heat exchanger in thermal communication with a thermoelectric heat pump, as described in more detail below. The thermoelectric heat pump may remove heat from the heat exchanger, thereby lowering the temperature of the heat exchanger below the temperature of the unconditioned medium in the environment. The thermoelectric pump also may raise the temperature of the heat exchange above the temperature of the unconditioned medium.

Accordingly, the unconditioned medium passing through the heat exchanger may be cooled to a conditioner temperature. Conversely, the unconditioned medium passing through the heat exchanger also may be heated to a conditioned temperature. In any event, the heat transfer assembly can change the temperature of the unconditioned medium to the conditioned temperature, when the unconditioned medium passes through the heat exchanger assembly.

In some embodiments, the heat transfer assembly (e.g., the thermoelectric pump and the heat exchanger) may move or rotate within the medium, which may improve heat transfer between the heat exchanger and the medium (as compared with a heat exchanger being stationary relative to the medium). For instance, the heat exchanger and/or the heat transfer assembly may rotate relative to a divider, partition, or housing, which may separate the medium in the controlled environment form the medium outside thereof, such as medium in an uncontrolled environment. Particularly, rotation of the heat exchanger may draw the unconditioned medium into the heat exchanger as well as expel conditioned medium therefrom. For example, the heat exchanger may have fins or wing-shaped heat transfer features that, upon rotation of the heat exchanger, may draw the medium into and through the heat exchanger. In other words, movement of the fins may produce flow or otherwise movement of the medium through the heat exchanger.

FIG. 1A illustrates an embodiment of a heat transfer assembly 100. In the illustrated embodiment, the heat transfer assembly 100 includes a heat exchanger 110 in thermal communication with a first side of a thermoelectric heat pump 120. For instance, the heat exchanger 110 may be configured as an impeller-type heat exchanger. The thermoelectric heat pump 120 may lower the temperature of a first thermal side 121 thereof, which may also lower the temperature of the heat exchanger 110. Consequently, as the medium passes through the heat exchanger 110, the medium may be cooled by the heat exchanger 110 to a conditioned temperature. Alternatively, the thermoelectric heat pump 120 may raise the temperature of the first thermal side 121 thereof, thereby raising the temperature of the heat exchanger 110, which may raise the temperature of the medium to a conditioned temperature.

In addition, the heat exchanger 110 may be attached to the thermoelectric pump 120 via a mechanical and/or chemical connection or the heat exchanger 110 integrated with the thermoelectric heat pump 120. Thus, there is no air bearing between the heat exchanger 110 and the thermoelectric heat pump 120 and, in some embodiments there may not even be a gap between the heat exchanger 110 and the thermoelectric heat pump 120. In an embodiment, the heat exchanger 110 and the thermoelectric heat pump 120 may be brazed together and/or mechanically fastened together so that the heat exchanger 110 and the thermoelectric heat pump 120 may move together. In other words, the heat exchanger 110 and the thermoelectric heat pump 120 may be fixedly connected together. Hence, the heat exchanger 110 and the thermoelectric heat pump 120 may be substantially stationary relative to each, for instance, while the heat exchanger 120 moves through the medium.

In the illustrated embodiment, the heat exchanger 110 has multiple heat transfer features 111 extending from a base 112. The heat transfer features 111 may be connected to or integrated with the base 112. Specifically, the heat transfer features 111 may be in thermal and mechanical communication with the base 112, such as to facilitate heat transfer between the heat transfer features 111 and the base 112 as well as transmit forces therebetween. For example, the movement of the base 112 may be transmitted to the heat transfer features 111, such that the heat transfer features 111 move together with the base 112.

The heat transfer features 111 and/or the base 112 may include any number of materials of suitable thermal conductivity and mechanical properties (e.g., strength). Such materials include but are not limited to aluminum, aluminum alloys, steel, copper, copper alloys, (e.g., brass), etc. Moreover, the heat transfer features 111 and/or the base 112 may be incorporate one or more coatings, which may increase thermal conductivity at the respective surfaces thereof, reduce drag, increase abrasion resistance, and combinations thereof.

The heat transfer features 111 may be spaced apart from one another in a manner that allows the unconditioned medium to move or flow therebetween. As the unconditioned medium flows between and/or about the heat transfer features 111, the medium may exchange heat with the heat transfer features 111. Hence, when the temperature of the heat transfer features 111 is higher than the temperature of the unconditioned medium, the heat transfer features 111 may raise the temperature of the medium, providing a conditioned medium at an outlet or outflow location. Conversely, when the temperature of the heat transfer features 111 is lower than the temperature of the unconditioned medium, the heat transfer features 111 may lower the temperature of the medium.

Additionally, as further described below, the heat transfer features 111 may pull or draw the unconditioned medium into the heat transfer assembly 100, to condition the unconditioned medium in the environment. For instance, the heat transfer features 111 may have fin- or wing-like shapes to define fin or wings, which may induce movement of the medium into and/or out of the heat transfer assembly 100. In an embodiment, the heat transfer assembly 100 may rotate about an axis 10, such that the heat transfer features 111 (when immersed in the surrounding medium) may draw the surrounding medium into the inlet and expel the conditioned medium from the outlet.

In an embodiment, the heat transfer features 111 and base 112 can rotate about the axis 10, thereby causing the surrounding medium to move or flow into the inlet, about or past the heat transfer features 111, and out of the outlet of the heat transfer assembly 100. For example, the surrounding medium may be drawn into the center of the heat exchanger 110 and expelled through the spaces between the heat transfer features 111. As described in more detail below, a medium conditioning system may also include a housing that may channel the conditioned medium out of one or more outlets, after the medium passes through the heat exchanger 110. Moreover, heat transfer features such as 111 may be augmented with secondary fins, louvers, projections, microchannels, etc. directed to increasing the surface area of such heat transfer features.

The thermoelectric heat pump 120 may produce a first temperature at the first thermal side 121 thereof and a second temperature at a second thermal side 122. For instance, the thermoelectric heat pump 120 can produce a temperature differential between the first and second thermal sides 121, 122, such that the first thermal side 121 has a lower temperature than the second thermal side 122. For example, the temperature differential may be about 5° C. to about 15° C., such as about 7° C. to about 10° C. Moreover, as noted above, the temperature of the first thermal side 121 may be lower than the temperature of the unconditioned fluid. Conversely, the temperature of the first thermal side 121 may be higher than the temperature of the second thermal side 122, and higher than the temperature of the unconditioned fluid.

In an embodiment, the thermoelectric heat pump 120 may be in thermal communication with the heat exchanger 110. More specifically, heat from the heat transfer features 111 may be transferred through the base 112 to the first thermal side 121 of the thermoelectric heat pump 120. Similarly, heat from the first thermal side 121 of the thermoelectric heat pump 120 may be transferred to the heat transfer features 111. Accordingly, as the unconditioned medium moves about the heat transfer features 111, heat from the unconditioned medium may be transferred through the heat transfer features 111 to the first thermal side 121 of the thermoelectric heat pump 120. As such, the unconditioned medium may be cooled by the heat transfer features 111 as the unconditioned medium moves through the heat transfer assembly 100, and may exit from the heat transfer assembly 100 as conditioned medium at the conditioned temperature, which may be lower than the temperature of the unconditioned medium. Consequently, circulating unconditioned medium through the heat transfer assembly 100 may cool the medium in a controlled environment to a suitable temperature.

Additionally or alternatively, the heat transfer assembly 100 may heat the unconditioned medium to a suitable temperature of the conditioned medium that may exit the heat transfer assembly 100. Particularly, the thermoelectric heat pump 120 may transfer heat from the first thermal side 121 to the heat transfer features 111, which may heat the unconditioned medium, as the unconditioned medium moves through the heat transfer assembly 100. Hence, the conditioned medium exiting the heat transfer assembly 100 may have a higher temperature than the unconditioned medium. In any event, the heat transfer assembly 100 may raise, lower, or maintain temperature of the medium in the environment.

Moreover, as mentioned above, the heat transfer assembly 100 may move through or within the surrounding medium. In an embodiment, the heat transfer assembly 100 may rotate about the axis 10, which may produce medium movement or circulation through the heat exchanger 110. For example, the heat transfer features 111 of the heat exchanger 110 may induce movement of the medium through the heat exchanger 110, as the heat transfer assembly 100 rotates, such as movement of the medium between the heat transfer features 111.

In some instances, boundary layer effects may limit the efficiency of heat transfer between the heat transfer features 111 and the unconditioned medium, such as fluid, moving through the heat exchanger 110. In other words, the boundary layer may partially insulate the heat transfer features 111, thereby reducing heat transfer between the heat transfer features 111 and the fluid. In one example, rotation of the heat exchanger 110 within the surrounding fluid may exert centrifugal forces on the boundary layer, which may thin or otherwise disrupt the boundary layer, thereby reducing insulating effects thereof and increasing heat transfer between the heat transfer features 111 and the fluid or other medium.

Furthermore, the heat transfer features 111 may have various features that may induce or enhance turbulent flow of the fluid through the heat exchanger 110. For instance, the heat transfer features 111 may have varying curvature which may aid in inducing or increasing turbulence in the flow of fluid or other medium. Turbulent flow may further disrupt the boundary layer, thereby increasing the heat transfer efficiency between the medium and the heat transfer features 111, which may lead to overall increase in efficiency of the heat transfer assembly 100.

The heat transfer features 111 may have any suitable shape and size, which may vary from one embodiment to the next. In an embodiment, the heat transfer features 111 may have a fin-like shape and may be arranged about an axis of rotation, in a manner that forms an impeller, which (as described above) may draw medium through the heat transfer assembly. For instance, the heat transfer features 111 may be curved and may have a tapered shape, such that the ends of the heat transfer features 111 closes to the center of the heat exchanger 110 may be thinner than the ends farthest away therefrom. Hence, in an embodiment, adjacent heat transfer features 111 may have the same space between the ends closest to and farthest from the center of the heat exchanger 110. Additional or alternative embodiments may include heat transfer features that have approximate uniform thickness.

Moreover, in some embodiments, the heat transfer features 111 may be curved. Alternatively, at least some of the heat transfer features may be approximately planar. In any event, however, the heat transfer features may move together with the heat exchanger 110 and through the medium. In some embodiments, additional structures such as secondary fins or microchannels may be adapted to provide higher surface area at the air-to-heat-exchanger interface.

Figure 1B:
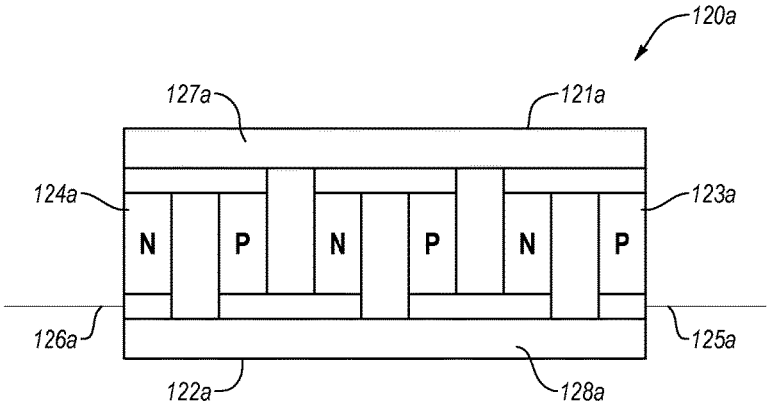
FIG. 1B is a schematic diagram of a thermoelectric heat pump according to an embodiment of the invention.

The particular thermoelectric heat pump 120 may vary from one embodiment to the next and may have any number of suitable sizes, shapes, and configurations. In any case, however, the thermoelectric heat pump 120 may produce a temperature differential between the first thermal side 121 and second thermal side 122 thereof. FIG. 1B illustrates an embodiment of a thermoelectric heat pump 120*a*. Except as otherwise described herein, the thermoelectric heat pump 120 (FIG. 1A) and its materials, elements, or components may be similar to or the same as the thermoelectric heat pump 120*a* and its respective materials, elements, and components.

In an embodiment, the thermoelectric heat pump 120*a* may utilize the Peltier effect to produce a temperature differential between a first thermal side 121*a* and second thermal side 122*a*. For instance, the thermoelectric heat pump 120*a* may include P-type and N-type semiconductor posts 123*a*, 124*a* connected together in series. Specifically, the P-type and N-type semiconductor posts 123*a* and 124*a* may also be electrically coupled to positive and negative electrical leads, such as leads 125*a*, 126*a*, which may connect the thermoelectric heat pump 120*a* to a power source.

In any event, the leads 125*a*, 126*a* may apply a voltage to P-type and N-type semiconductor posts 123*a* and 124*a*. Upon application of voltage, heat may flow across the P-type and N-type semiconductor posts 123*a* from the positive side to the negative side. Conversely, when the voltage is applied across the P-type 124*a*, heat may flow from the negative side to the positive side. Hence, connecting the P-type and N-type semiconductor posts 123*a*, 124*a* in series may produce the first thermal side 121*a* and the second thermal side 122*a* of the thermoelectric heat pump 120*a*, and the heat may flow from the first thermal side 121*a* to the second thermal side 122*a* and vice versa (depending on the polarity of the leads 125*a*, 126*a*).

The first and second thermal sides may have any suitable shape, position, and orientation relative to each other. In some embodiments, the first thermal side 121*a* and/or the second thermal side 122*a* may be planar and/or substantially uniform. For example, the thermoelectric heat pump 120*a* may include ceramic substrates or plates 127*a*, 128*a*, which may form or define the first and second thermal sides 121*a*, 122*a*, respectively. In some instances, the plates 127*a*, 128*a* also may have an approximately uniform temperature distribution across the respective surfaces thereof. In any event, the first and second thermal sides 121*a*, 122*a* may be in thermal communication with the heat exchanger (such as the heat exchanger 110 (FIG. 1A)), which may allow heat transfer to and/or from the heat transfer features of the heat exchanger.

It should be appreciated that, in an embodiment, any of the plates 127*a*, 128*a* may form the base of the heat exchanger. That is, the heat transfer features of the heat exchanger may extend directly from one or more of the plates 127*a*, 128*a*. Also, in one embodiment, inward facing sides of the plates may be coated with material that may be thermally conductive while providing suitable electrical insulation (e.g., diamond, thermally conductive plastics, etc.). For instance, the plates 127*a*, 128*a* may comprise aluminum or an aluminum alloy, and may have the inward facing sides thereof diamond coated. In any case, in some instances, the heat exchanger may be substantially integrated with the thermoelectric heat pump.

In some embodiments, when heat is removed from the heat transfer features of the heat exchanger and transferred to the first thermal side 121*a*, heat may be further transferred to the second thermal side 122*a* in a manner described above. Hence, the temperature of the second thermal side 122*a* may continue to increase. In some instances, the second thermal side 122*a* may be exposed to medium (e.g., medium outside of a controlled environment), which may have a lower temperature than the temperature of the second thermal side 122*a*. For example, when cooling a building, a room, or similar environment, the second thermal side 122*a* of the thermoelectric heat pump 120*a* may be exposed to ambient air located outside of such a building or room. As such, the ambient air may at least partially cool the second thermal side 122*a*.

In some embodiments, removing heat from the second thermal side 122*a* may increase efficiency of the thermoelectric heat pump 120*a*. Furthermore, in an embodiment, the second thermal side 122*a* may include structures and/or features connected thereto or incorporated therewith, which may increase or otherwise improve heat transfer to and/or from the second thermal side 122*a*. For example, the second thermal side 122*a* may include features or structures that may have an increased overall surface area exposed to a medium (as compared with the surface area of the second thermal side 122*a*). In some embodiments, the second thermal side 122*a* may be in thermal communication with fins, wings, plates, other heat transfer features, and combinations thereof.

Figure 2:
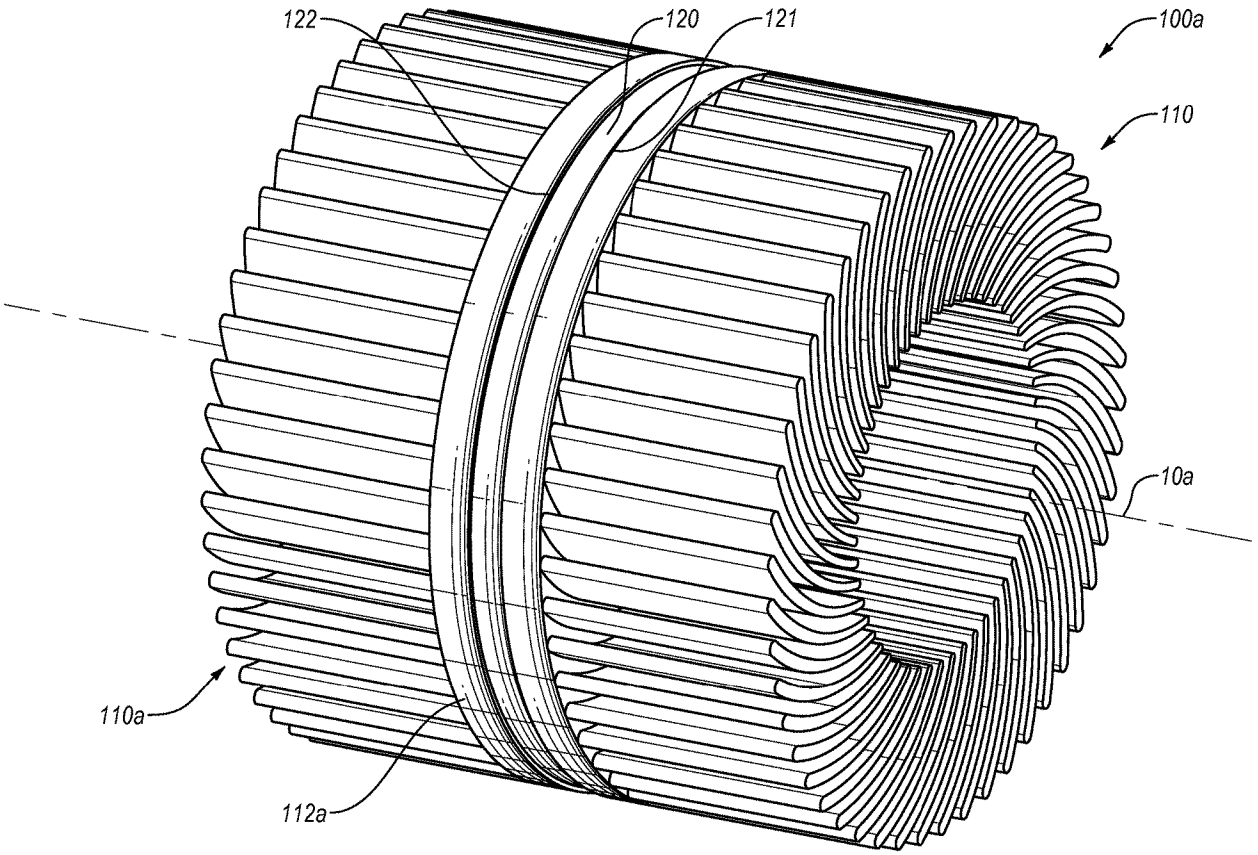
FIG. 2 is an isometric view of a heat transfer assembly according to another embodiment of the invention.

FIG. 2 illustrates another embodiment of a heat transfer assembly 100*a* that includes a second heat exchanger 110*a* (e.g., an impeller-type heat exchanger) in thermal communication with the thermoelectric heat pump 120. Except as otherwise described herein, the heat transfer assembly 100*a* and its materials, elements, or components may be similar to or the same as the heat transfer assembly 100 (FIG. 1A) and its respective materials, elements, and components. In some embodiments, the heat exchanger 110*a* may be in thermal communication with the second thermal side 122 of the thermoelectric heat pump 120, while the heat exchanger 110 may be in thermal communication with the first thermal side 121 of the thermoelectric heat pump 120. It should be appreciated that the heat exchanger 110*a* and its materials, elements, or components may be similar to or the same as the heat exchanger 110 and its respective material, elements, and components. For instance, the heat exchanger 110*a* may include one or more heat transfer features 111*a* in thermal and/or mechanical communication with a base 112*a*, which may be similar to or the same as the heat transfer features 111 and the base 112 of the heat exchanger 110.

Similar to the heat transfer features 111, the heat transfer features 111*a* may transfer heat to and from the second thermal side 122. For example, the heat transfer features 111*a* may be exposed to fluid or other medium of lower temperature than the temperature of the heat transfer features 111*a* and/or of the second thermal side 122. Accordingly, the heat from the second thermal side 122 may transfer to the heat transfer features 111*a* and to such fluid or medium of lower temperature.

In an embodiment, the heat transfer assembly 100*a* may rotate about the axis 10*a* within the surrounding medium. Specifically, in some instances, the heat exchanger 110 may move through and/or within the medium in a controlled environment (e.g., within the unconditioned medium). Conversely, the heat exchanger 110*a* may move through and/or within the fluid in an uncontrolled environment. Movement of the heat exchanger 110*a* may be similar to or the same as the movement of the heat exchanger 110 described above. For example, rotation of the heat transfer assembly 100*a* about the axis 10*a* may exert centrifugal force on boundary layers surrounding the heat transfer features 111*a* of the heat exchanger 110*a*, thereby reducing the boundary layers and increasing efficiency of heat transfer between the surrounding medium and the heat transfer features 111*a*.

Moreover, rotation of the heat transfer assembly 100*a* may produce rotation of the heat exchangers 110 and 110*a*, such that, for example, the heat exchanger 110 draws and expels medium in the controlled environment, and the heat exchanger 110*a* draws and expels medium in the uncontrolled environment. Also, in some embodiments, rotation of the heat transfer assembly 100*a* may reduce and/or disrupt the respective boundary layers about the heat transfer features 111 and 111*a*, which may lead to increased heat transfer efficiency thereof. Accordingly, the heat transfer assembly 100*a* may exhibit increased efficiency as compared with conventional cooling and/or heating systems. It should be also appreciated that, in some instances, the use of certain conventional structures adapted to medium conditioning such as mechanical compressors, high pressure plumbing, and/or the use of refrigerants may be undesirable.

Like the heat exchanger assembly 100, the heat exchangers 110 and 110*a* may be respectively attached to the thermoelectric pump 120 via a mechanical and/or chemical connection or the heat exchangers 110 and 110*a* may be respectively integrated with the thermoelectric heat pump 120. Thus, there is no air bearing between the heat exchangers 110, 110*a* and the thermoelectric heat pump 120 and, in some embodiments there may not even be a gap between the heat exchangers 110,110*a* and the thermoelectric heat pump 120. In an embodiment, the heat exchangers 110, 110*a* and the thermoelectric heat pump 120 may be brazed together and/or mechanically fastened together so that the heat exchangers 110, 110*a* and the thermoelectric heat pump 120 may move together. In other words, the heat exchangers 110 and 110*a* and the thermoelectric heat pump 120 may be fixedly connected together.

Furthermore, it should be appreciated that unlike conventional heating and/or cooling systems, the medium conditioning system 200 may have no moving parts in the thermoelectric heat pump 120. In other words, the thermoelectric heat pump 120 may cool and/or heat the heat exchangers 110, 110*a* without movement of parts or components, which may increase the useful life of the medium conditioning system 200 (as compared with a conventional heating or cooling system).

It should be appreciated that the type of medium in the controlled environment may be different than the medium in the uncontrolled environment. For example, the medium in the controlled environment may be gas, while the medium outside of the controlled environment may be liquid, and vice versa. Nevertheless, in some instances, the medium in the controlled environment may be the same as the medium outside thereof.

Figure 3:
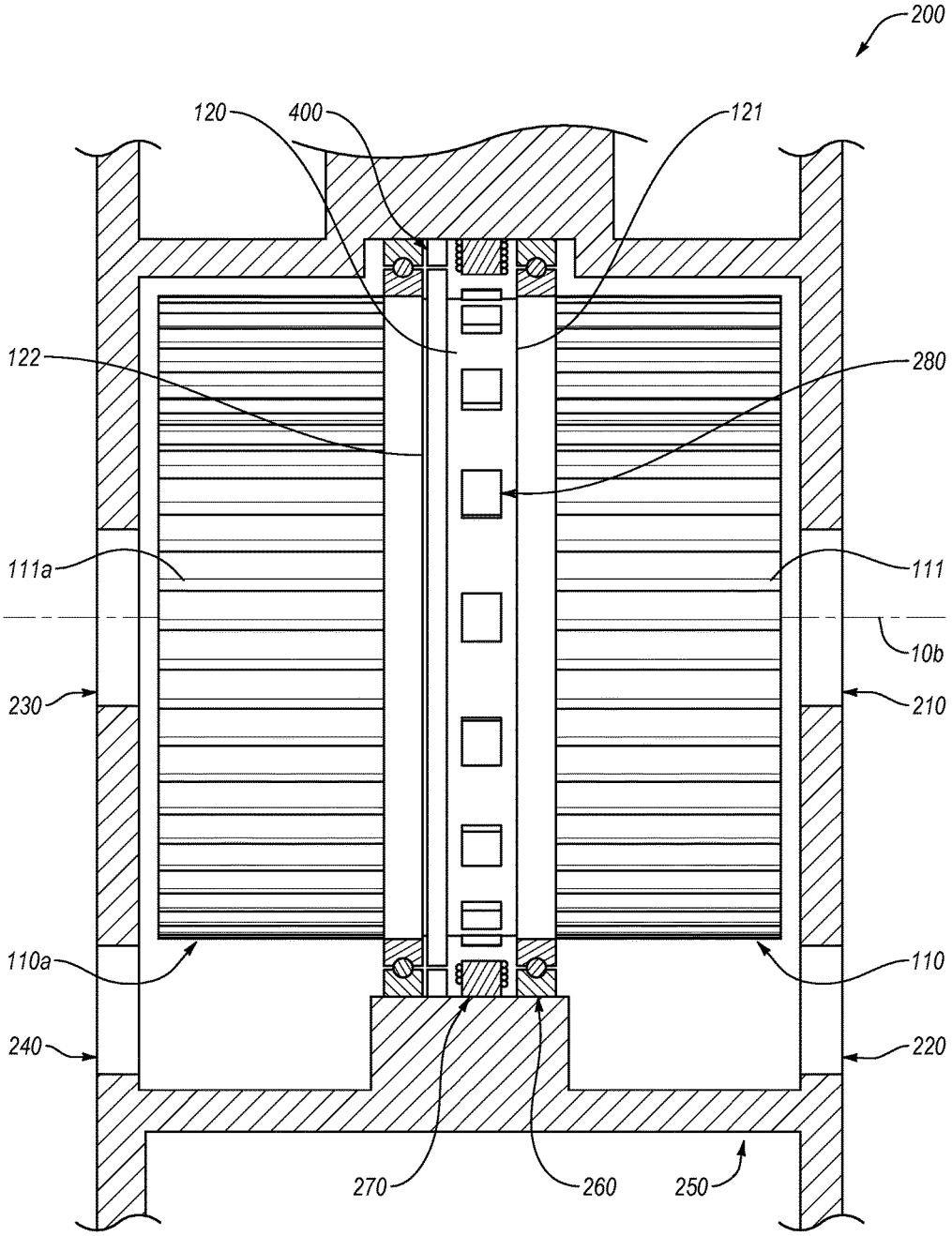
FIG. 3 is a cross-sectional view of a medium conditioning system according to an embodiment of the invention.

In any event, the heat transfer assembly 100*a* may be used in any number of suitable applications. For example, the heat transfer assembly 100*a* may be installed in a building or a room and may condition (i.e., heat and/or cool) air therein. FIG. 3 illustrates an embodiment representing an installation of a medium conditioning system 200, which may draw unconditioned medium, such as air or other fluid, from an environment, such as a room, through an inlet 210 and expel conditioned medium into the environment from an outlet 220. In an embodiment, the inlet 210 may be located or positioned about the axis of rotation of the heat transfer assembly 100*a*, such as the axis 10*b*. Hence, the medium circulated through the inlet 210 and outlet 220 may exit as conditioned medium. In some embodiments, the medium conditioning system 200 also may include exterior inlet and outlet 230, 240. The medium circulated through the inlet 230 and out of the outlet 240 may increase operating efficiency of the thermoelectric heat pump 120 (e.g., by cooling the second thermal side 122 of the thermoelectric heat pump 120).

In one embodiment, the medium conditioning system 200 may include the heat transfer assembly 100*a* rotatably secured within a divider or housing 250. The housing 250 may provide separation of the medium on the first thermal side 121 of the thermoelectric heat pump 120 from the medium on the second thermal side 122 of the thermoelectric heat pump 120. As such, for instance, the housing 250 may prevent or minimize mixing of the medium (e.g., air) in the uncontrolled environment with the medium in the controlled environment. It should be appreciated that the term housing is not intended as limiting and may include and suitable structure that may separate or partition media on opposing sides of the thermoelectric heat pump 120 and/or rotatably secure the heat transfer assembly 100*a*. For instance, a housing may be a panel or partition (e.g., an approximately planar panel) that may rotatably secure the thermoelectric heat pump 120 and may segregate the medium on the first thermal side 121 from the medium on the second thermal side 122 of the thermoelectric heat pump 120.

In an embodiment, the housing 250 may include a chamber that substantially encloses the heat exchanger 110. For example, the housing 250 may have openings that may form or define the medium inlet 210 and outlet 220, while otherwise enclosing the heat exchanger 110 within a first chamber. Accordingly, as the medium exits the heat exchanger 110, the housing 250 may force the medium to exit out of the opening defining the outlet 220. Similarly, the heat exchanger 110*a* may be enclosed in a chamber of the housing 250, which may include openings defining the medium inlet and outlet 230, 240. It should be appreciated that the housing 250 may have any number of openings that may form or define the respective media inlets and outlets 210, 230, 220, 240, which may vary from one embodiment to the next.

In some embodiments, the first thermal side 121 may be in thermal communication with unconditioned medium of a controlled environment (e.g., when the heat exchanger 110 circulates the medium through the medium conditioning system 200). Similarly, the second thermal side 122 may be in thermal communication with a medium outside of the controlled environment (e.g., when the heat exchanger 110*a* circulates the medium from an uncontrolled environment through the medium conditioning system 200). For instance, the heat exchanger 110 may draw air from a room and circulate the air through the medium conditioning system 200 and about the heat transfer features 111, thereby conditioning the air (e.g., cooling the air). The heat exchanger 110*a* also may circulate air outside of the room through medium conditioning system 200 and about the heat transfer features 111*a* (e.g., to cool the second thermal side 122 of the thermoelectric heat pump 120). For example, the medium conditioning system 200 may be mounted in a window or through a wall of a building so that heat exchanger 110 is disposed within a room while the heat exchanger 110 is disposed outside of the room. In other embodiments, the medium conditioning system 200 may be used to cool a chamber of a container, such as cooler for medicine or food. Thus, in such an application, the medium conditioning system 200 may be mounted to a container housing so that heat exchanger 110 is disposed within chamber of the container while the heat exchanger 110 is disposed outside of the container. Of course, there are numerous other applications for the medium conditioning system 200.

As mentioned above, in an environment, the heat transfer assembly 100*a* may rotate the heat exchanger 110 and the heat exchanger 110*a* through respective media. For instance, the heat transfer assembly 100*a* may rotate within the housing 250, thereby drawing the respective media into the inlets 210 and/or 230. Moreover, the respective media may be forced out of the outlets 220 and/or 240. In some instances, the medium conditioning system 200 may include one or more bearings, such as bearings 260, which may rotatably secure the heat transfer assembly 100*a* within the housing 250.

Furthermore, the medium conditioning system may include a power drive operably connected to the heat transfer assembly 100*a*, such that rotation of the heat transfer assembly 100*a* may be motorized. For example, the power drive may include a stator 270 and a rotor 280. In one embodiment, the stator 270 may be connected or secured to (and/or within) the housing 250, while the rotor 280 may be connected to the heat transfer assembly 100*a*. In other words, the stator 270 and rotor 280 together may form an AC motor configuration. In any case, providing power at the stator 270 may cause rotation of the heat transfer assembly 100*a* relative to the housing 250 (e.g., about an axis 10*b*).

In additional or alternative embodiments, that medium conditioning system 200 may include a power drive that mechanically drives the heat transfer assembly 100*a*. For instance, the power drive may include a belt-pulley configuration, a geared connection (e.g., a gearbox), a chain-sprocket configuration, etc., and combinations thereof. Furthermore, in some instances, heat generated by the stator 270 may be transferred to the hot side of the thermoelectric heat pump 120 (i.e., to either the first or second thermal side 121, 122), which may increase overall efficiency of the medium conditioning system 200.

Figure 4:
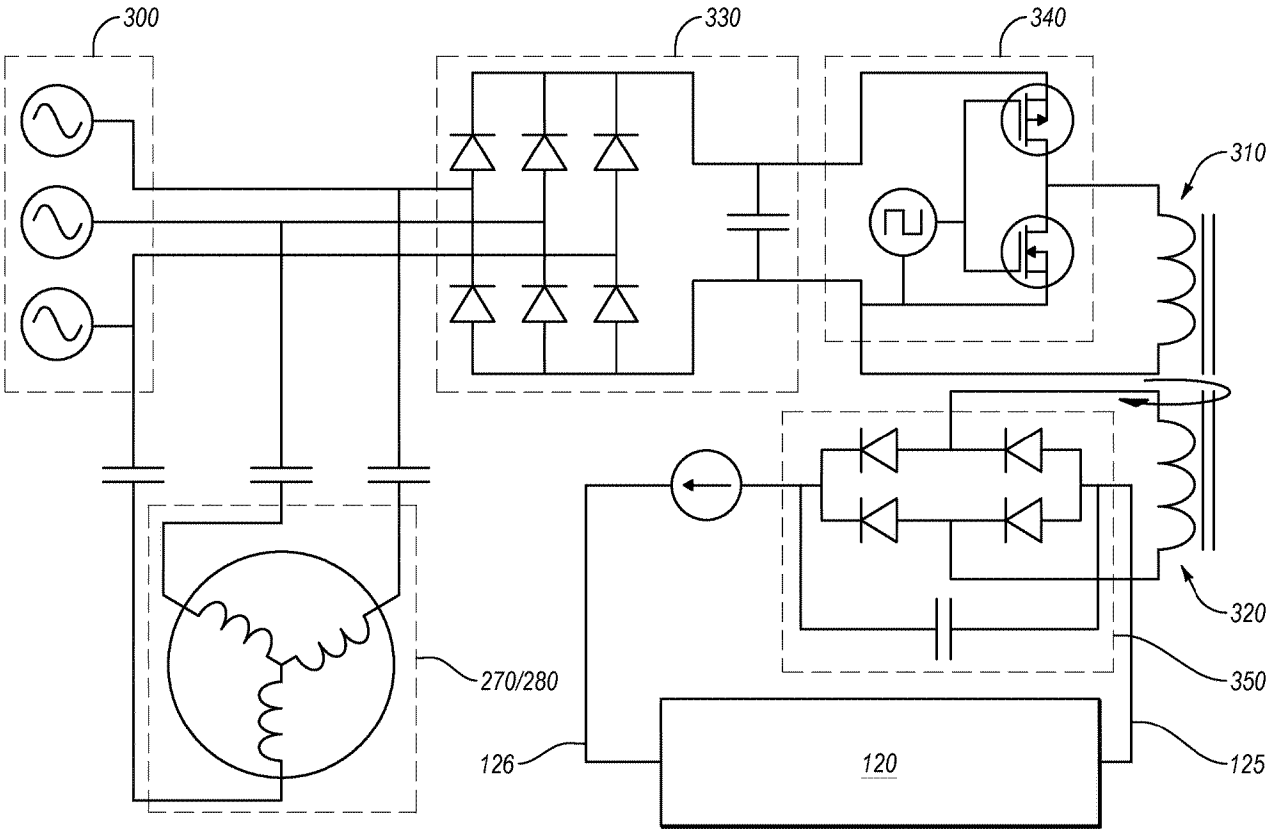
FIG. 4 is a schematic diagram of a connection between a power supply and a thermoelectric heat pump according to an embodiment of the invention.

It should be also appreciated that, as described above, the thermoelectric heat pump 120 may require electrical power to produce temperature differential between the first thermal side 121 and the second thermal side 122 thereof. Also, in some instances, the rotating thermoelectric heat pump 120 may be electrically coupled to a controller or power supply that may be stationary (i.e., the thermoelectric heat pump 120 may rotate relative to the power source or supply). Particular connection between a stationary power supply and the rotating thermoelectric heat pump 120 may vary from one embodiment to another. For example, as further described below, embodiments may include a rotary transformer 400, which may electrically couple the power supply to the rotating thermoelectric heat pump 120. Additional or alternative embodiments may include a brush and slip ring assembly as well as any number of other suitable connections, which may provide a connection between the power supply and the rotating thermoelectric heat pump 120. FIG. 4 illustrates a schematic diagram of an embodiment of rotary transformer, which may provide a suitable connection between the rotating thermoelectric heat pump 120 and a stationary power supply 300.

In some embodiments, the power supply 300 may provide 3-phase AC power to power the thermoelectric heat pump at 120 V and 60 Hz. It should be appreciated that in additional or alternative embodiments, the power supply may provide single-phase or poly-phase AC power at any suitable frequency and/or voltage. Furthermore, in some instances, the power supply may provide DC power at any suitable voltage. In some embodiments, means of inductively coupling of electrical power rotating thermoelectric heat pump elements may comprise a flyback transformer and/or other structures adapted to various types of dc-to-dc converters.

In some instances, a primary coil 310 may receive AC power (e.g., a square wave alternating current), which may be transmitted via induction to a secondary coil 320. For example, a rectifier 330 and an inverter, such as a half H bridge 340 may be electrical coupled between the power supply 300 and the primary coil 310, which may provide a square wave AC power at the primary coil 310. A secondary coil 320 may be in mechanical and electrical connection with the thermoelectric heat pump 120, such that rotation of the thermoelectric heat pump 120 may produce rotation of the secondary coil 320 relative to and/or within the primary coil 310. Such relative rotation may induce current flow in the secondary coil 320, thereby transmitting power to the thermoelectric heat pump 120.

To provide DC current at the thermoelectric heat pump 120, a rectifier, such as a square wave rectifier 350, may be electrically coupled between the secondary coil 320 and the thermoelectric heat pump 120. In any event, the thermoelectric heat pump 120 may receive suitable power, while rotating relative to the power supply 300. Also, the power supply 300 may power the rotation of the heat transfer assembly and of the thermoelectric heat pump 120. As described above, the heat transfer assembly may include a rotor, while the housing may secure the stator. For instance, the power supply 300 may power the stator coil, thereby rotating the heat transfer assembly relative to the housing. Additionally or alternatively, the power supply 300 may power a motor that may be mechanically connected (e.g., via belt or gear drive) to the heat transfer assembly, and which may rotate the heat transfer assembly relative to the housing.

As noted above, the thermoelectric heat pump 120 may produce a temperature differential between the first and second thermal sides thereof. Moreover, reversing polarity of the leads 125, 126, which transmit power to the thermoelectric heat pump 120, also may reverse the heat flow in the thermoelectric heat pump 120. For example, in a first configuration, the first and second leads may have respective negative and positive polarities and the thermoelectric heat pump 120 may have a lower temperature on the first thermal side than on the second thermal side. In a second configuration, reversing the polarity of the first and second leads (i.e., to positive and negative respectively) may produce a lower temperature on the second thermal side than on the first thermal side of the thermoelectric heat pump 120.

In an embodiment, a switch may be electrically coupled to the rectifier 350, which may switch polarity of the leads 125, 126 connected to the thermoelectric heat pump 120. Hence, such switch may allow the thermoelectric heat pump 120 to heat and/or cool either the first or second thermal side thereof. Consequently, heat transfer assembly may heat and/or cool the medium in the controlled environment.

Figure 5A:
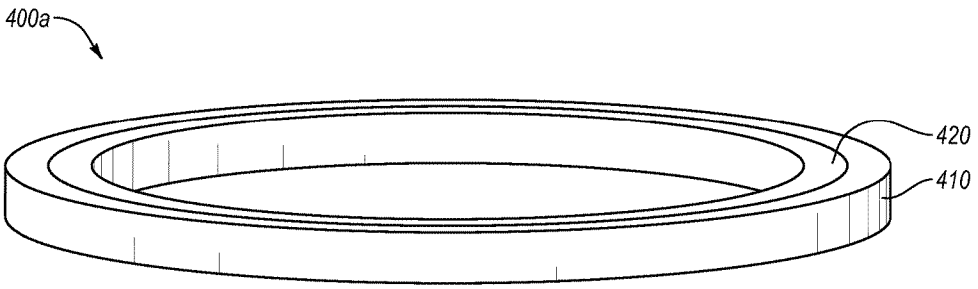
FIG. 5A is an isometric view of rings that may house one or more of a primary and secondary coils for electrically coupling the thermoelectric heat pump to a power supply according to an embodiment of the invention.

The primary coil 310 and secondary coil 320 may be mechanically connected together (e.g., rotatably connected together) as well as to the thermoelectric heat pump 120 and/or to the housing of the conditioning system in any number of suitable configurations. For instance, two concentric rings illustrated in FIG. 5A may house the primary and secondary coils. Particularly, a rotary transformer 400*a* may include two connector rings, such as an outer ring 410 and an inner ring 420 may provide the connection between the power supply and the rotatable thermoelectric pump 120. In one embodiment, the outer ring 410 may include the primary coil, which may remain substantially stationary relative to the power supply, and the inner ring 420 may include the secondary coil.

Figure 5B:
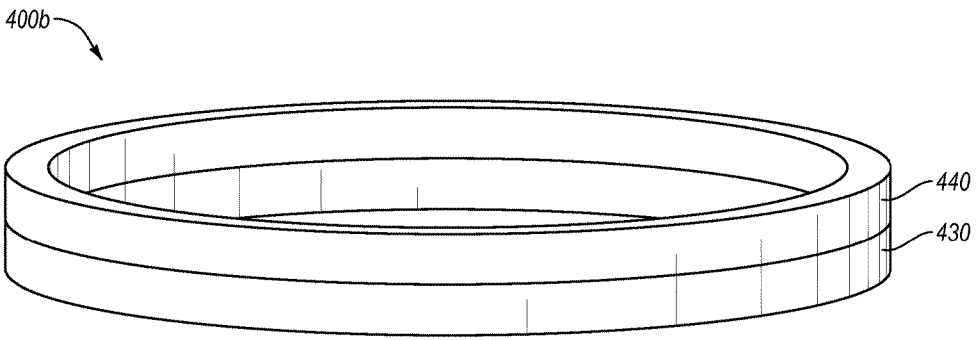
FIG. 5B is an isometric view of rings that may house one or more of a primary and secondary coils for electrically coupling the thermoelectric heat pump to a power supply according to another embodiment of the invention.

The inner ring 420 may be physically connected to the thermoelectric heat pump and/or to another element or component of the heat transfer assembly, such as by press-fitting, brazing, a mechanical connection, or combinations thereof. As such, the inner ring 420 may rotate relative to the outer ring 410. For example, the outer ring 410 and the inner ring 420 may have a slip fit therebetween, which may allow the outer ring 410 and inner ring 420 to rotate relative to one another. In additional or alternative embodiments, the primary and secondary coils may be included in two adjacent rings, which may be stacked next to each other axially. FIG. 5B illustrates another embodiment for a rotary transformer 400*b*, which includes a first ring 430 and a second ring 440, which may be positioned near one another. The primary and secondary coils may be included in the respective first and second rings 430 and 440 or vice versa. Hence, one of the first and second rings 430, 440 that includes the primary coil may remain stationary relative to the power supply, while the other may rotate relative to the stationary ring (e.g., the first ring 430 may be connected to the housing, while the second ring 440 may be connected to the thermoelectric heat pump). It should also be understood that the structures illustrated in FIG. 5 represent only one of many possible geometrical arrangements for inductive coupling of electrical power across a rotating interface. Accordingly, in some embodiments, the primary and secondary coils include windings and/or magnetic cores of varying sizes and aspect ratios in which the transmission of magnetic flux between the primary and secondary may occur in the radial direction, axial direction, or both. Alternatively, one or more permanent magnet structures and/or electromagnet structures residing in the stationary frame may be used to induce flow of electrical current in one or more coils residing in the rotating frame in a manner analogous to an electrical generator, rather than an electrical transformer.

While various aspects and embodiments have been disclosed herein, other aspects and embodiments are contemplated. The various aspects and embodiments disclosed herein are for purposes of illustration and are not intended to be limiting.

The invention claimed is:

1. A system for conditioning a medium in an environment, the system comprising:

a housing sized and configured to at least partially separate a first fluid at a first location from a second fluid at a second location;

a heat transfer assembly rotatably connected to the housing, the heat transfer assembly including:

a thermoelectric heat pump having a first thermal side and a second thermal side, the thermoelectric heat pump being configured to produce a temperature differential between the first thermal side and the second thermal side thereof; and a heat exchanger in thermal communication with the first thermal side of the thermoelectric heat pump, the heat exchanger being attached to the thermoelectric heat pump, the heat exchanger including one or more heat transfer features extending away from the first thermal side of the thermoelectric heat pump; and a rotary transformer configured to provide an electrical connection between a power supply and the thermoelectric heat pump, the rotary transformer includes a first connector ring configured to be electrically coupled to the power supply and a second connector ring configured to be electrically coupled to the thermoelectric heat pump.

2. The system as recited in claim 1, wherein the one or more heat transfer features of the heat exchanger define one or more fins, and the heat exchanger is configured as an impeller.

3. The system as recited in claim 1, wherein the heat exchanger further includes a base in thermal communication with the thermoelectric heat pump, the one or more heat transfer features being attached to the base.

4. The system as recited in claim 1, further comprising a power drive operably connected to the heat transfer assembly.

5. The system as recited in claim 4, wherein the power drive includes a rotor connected to the heat transfer assembly and a stator connected to the housing.

6. The system as recited in claim 1, wherein rotation of the heat transfer assembly during operation thereof draws the medium into the heat exchanger and moves the medium between the one or more heat transfer features of the heat exchanger.

7. The system as recited in claim 1, wherein:

the first connector ring is fixedly connected to the housing and includes a primary coil; and the second connector ring includes a secondary coil, the second connector ring being rotatable relative to the first connector ring and being fixedly connected to the heat transfer assembly.

8. The system as recited in claim 7, further comprising a rectifier configured to be electrically coupled to the power supply and electrically coupled to the primary coil.

9. The system as recited in claim 8, further comprising:

an H bridge electrically coupled between the rectifier and the primary coil; and a square wave rectifier electrically coupled between the secondary coil and the thermoelectric heat pump.

10. A system for conditioning a medium in an environment, the system comprising:

a housing sized and configured to at least partially separate a first fluid at a first location from a second fluid at a second location;

a heat transfer assembly rotatably connected to the housing, the heat transfer assembly including:

a thermoelectric heat pump having a first thermal side and a second thermal side, the thermoelectric heat pump being configured to produce a temperature differential between the first thermal side and the second thermal side thereof;

a first heat exchanger in thermal communication with the first thermal side of the thermoelectric heat pump, the first heat exchanger being attached to the thermoelectric heat pump; and a second heat exchanger in thermal communication with the second thermal side of the thermoelectric heat pump, the second heat exchanger being attached to the thermoelectric heat pump; and a rotary transformer configured to provide an electrical connection between a power supply and the thermoelectric heat pump, the rotary transformer includes a first portion and a second portion, the first portion electrically coupled to the power supply, the second portion electrically coupled to the thermoelectric heat pump, the first portion fixedly connected to the housing, the second portion being rotatable relative to the first portion and being fixedly connected to the heat transfer assembly.

11. The system as recited in claim 10, wherein the first heat exchanger includes one or more heat transfer features extending away from the first thermal side of the thermoelectric heat pump.

12. The system as recited in claim 11, wherein at least one of the first heat exchanger or the second heat exchanger are configured as impeller heat exchangers.

13. The system as recited in claim 12, wherein the housing encloses the heat transfer assembly therein.

14. The system as recited in claim 13, wherein the housing further includes one or more openings defining one or more medium inlets for one or more of the first heat exchanger or the second heat exchanger.

15. The system as recited in claim 14, wherein the housing further includes one or more openings defining one or more medium outlets from the one or more of the first heat exchanger or the second heat exchanger.

16. The system of claim 10, wherein the first portion of the rotary transformer includes a first connector ring, the first connector ring is fixedly connected to the housing and includes a primary coil, the second portion of the rotary transformer includes a second connector ring that includes a secondary coil, the second connector ring being rotatable relative to the first connector ring and being fixedly connected to the heat transfer assembly.

17. A system for conditioning a medium in an environment, the system comprising:

a housing configured to at least partially separate a first fluid at a first location from a second fluid at a second location;

a heat transfer assembly rotatably connected to the housing, the heat transfer assembly including:

a thermoelectric heat pump having a first thermal side and a second thermal side, the thermoelectric heat pump being configured to produce a temperature differential between the first thermal side and the second thermal side thereof; and a heat exchanger in thermal communication with the first thermal side of the thermoelectric heat pump, the heat exchanger being attached to the thermoelectric heat pump, the heat exchanger including one or more heat transfer features extending away from the first thermal side of the thermoelectric heat pump; and a rotary transformer configured to provide an electrical connection between a power supply and the thermoelectric heat pump, the rotary transformer comprising a first portion and a second portion, the first portion remaining stationary relative to the power supply, the second portion mechanically coupled to the heat transfer assembly.

18. The system of claim 17, wherein the first portion of the rotary transformer comprises a first ring element that includes a primary coil and the second portion of the rotary transformer comprises a second ring element that includes a secondary coil.

19. The system of claim 18, wherein the first ring element has a first diameter, the second ring element has a second diameter, the first diameter being greater than the first diameter, the first ring element and the second ring element positioned concentrically around a same axis.

20. The system of claim 18, wherein the first ring element and the second ring element are positioned adjacent to one another along a same axis.

* * * * *